US005348144A

United States Patent [19]

Maier

[11] Patent Number: 5,348,144

[45] Date of Patent: Sep. 20, 1994

[54] ARTIST SKETCH BOX

[76] Inventor: Michael L. Maier, 1392 Southfork Rd., Cody, Wyo. 82604

[21] Appl. No.: 60,356

[22] Filed: May 11, 1993

[51] Int. Cl.[5] ..... B05C 17/00; B44D 3/00

[52] U.S. Cl. ..... 206/1.7; 206/1.8; 220/528

[58] Field of Search ..... 206/1.7, 1.8, 371, 372, 206/373; 220/521, 522, 528, 553

[56] References Cited

U.S. PATENT DOCUMENTS

| | | | |
|---|---|---|---|
| 513,044 | 1/1894 | Handlan, Jr. | 220/528 |
| 1,175,070 | 3/1916 | Maxwell | 206/1.7 |
| 1,221,510 | 4/1917 | Christensen | 206/1.7 |
| 2,248,871 | 7/1941 | Howe | 200/1.8 |
| 2,515,703 | 7/1950 | Dumas | 206/1.7 |
| 2,528,249 | 10/1950 | Serwin | 220/552 |
| 2,541,890 | 2/1951 | Schaperkotter et al. | 220/522 |
| 2,648,933 | 8/1953 | Brooks et al. | 206/1.7 |
| 2,867,928 | 1/1959 | Angell | 206/1.8 |
| 3,576,252 | 4/1971 | Conolly | 206/1.7 |
| 3,672,742 | 6/1972 | Barg | 206/1.7 |
| 4,061,224 | 12/1977 | Fuhri | 206/1.7 |
| 4,142,627 | 3/1979 | Szegi | 206/1.7 |
| 4,470,488 | 9/1984 | Broussard | 206/1.7 |
| 4,591,056 | 5/1986 | Groch | 206/1.7 |
| 4,852,725 | 8/1989 | Folsom | 206/1.7 |
| 4,858,955 | 8/1989 | Holt | 206/1.7 |
| 5,027,972 | 7/1991 | Bartholomew | 220/528 |
| 5,163,547 | 11/1992 | Hsieh | 206/1.7 |

*Primary Examiner*—David T. Fidei

*Attorney, Agent, or Firm*—Douglas Clarkson; Risto A. Rinne, Jr.

[57] ABSTRACT

An improved artist sketch box is described as including a bottom with upstanding walls attached to the bottom generally about the perimeter forming a base compartment, diagonal members affixed within the base compartment further defining the area therein, a lid assembly of approximately the same peripheral configuration as the base compartment hinged to one of the upstanding walls, and as having lid walls attached to the lid assembly adapted for receiving one or more artist panels and a panel board member hinged to the lid assembly to provide access for inserting or removing the artist panels from the lid assembly. The lid assembly pivots about its hinges so that the lid walls and panel board member align with the upstanding walls to form a box. A lightweight easel and palette assembly is provided that fits within the box and is removable separate and apart from the box for use. The easel and palette assembly includes a palette base assembly that is hinged to an easel assembly that is adapted for receiving an artist panel board. The palette base assembly and easel assembly pivot with respect to each other and are secured in position by a slotted brace and thumbscrew. The easel and palette assembly are either hand held by the artist during use or are affixed to a camera type of tripod.

17 Claims, 2 Drawing Sheets

ARTIST SKETCH BOX

BACKGROUND OF THE INVENTION

1. Field of the Invention

The present invention, in general, relates to containers used by artists to transport supplies and, more particularly, to portable art supply boxes.

Artists often travel in the field to remote locations for inspiration and whilst in search of subject matter. When a suitable landscape is found, wildlife is sighted, or a particularly pleasing sunrise or sunset is seen, the artist typically makes a crude sketch of the scene noting that which is significant and omitting detail of that which is not deemed especially important.

For example, an artist may sketch the colors of a sunset while simultaneously taking a photograph to capture more of the surrounding landscape detail. Later the artist will use his "field sketch" along with the photograph to paint the formal painting in whatever medium he chooses at his studio.

Artists must carry certain essential materials in the field in order to be able to compose a preliminary type of sketch. At a minimum an artist needs to transport into the field a board upon which to do the sketch (often referred to as either a panel board or a canvas board), a medium such as a variety of oil base paints, a palette to mix the paints, an easel to hold the board, assorted brushes, and paint thinner. Depending upon the preferences of each artist, other supplies will also be required.

However, the problem encountered by most artists is that it is difficult to transport these items into the field conveniently, and at minimum weight. Boxes have been fashioned to contain and to transport most of these essential art supplies. These types of boxes are often referred to in general as "artist sketch boxes".

However present types of artist sketch boxes either are too large and heavy to be comfortably transported into remote areas, or they require the artist to compromise his needs by either leaving behind certain items that he would desire to transport or modifying equipment to fit into the available space. For example, it is not uncommon to require artists to cut off the handles from their paint brushes so that the shortened brushes can fit inside the compartment space of compact types of artist sketch boxes.

As is a common practice while making field sketches, the artist will typically support both the easel and the palette by hand. However, many prior types of artist sketch boxes include the palette area for mixing the paints as a part of the base assembly of the sketch box or include the easel which holds the sketch boards as a part of the lid of the box. Either of these types of designs is difficult to hold because the artist must support the full weight of the sketch box instead of just the weight of the easel and palette while making his preliminary type of sketch.

Accordingly there exists today a need for an artist sketch box that conveniently accommodates the most essential art supplies required for making field sketches while providing a light in weight integrated palette and easel assembly.

2. Description of Prior Art

Art supply boxes, generally, are known. For example, the following patents describe various types of these devices:

U.S. Pat. Nos. 961,629 to Maynard, Jun. 14, 1910;

2,515,703 to Dumas, Jul. 18, 1950;
2,648,933 to Brooks et al, Aug. 18, 1953;
2,804,226 to Freedman, Aug. 27, 1957;
2,940,200 to Endlich, Jun. 14, 1960;
4,372,630 to Fuhri, Feb. 8, 1983;
4,638,909 to Ford, Jan. 27, 1987;
5,014,850 to Huff, May 14, 1991.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an important object of the present invention to provide an improved artist sketch box that is easy to transport.

It is also an object of the invention to provide an improved artist sketch box that can hold full length artist paint brushes.

Another object of the invention is to provide an improved artist sketch box that includes a lightweight integrated easel and palette assembly that is removable from the sketch box.

Still another object of the invention is to provide an improved artist sketch box that includes an integrated easel and palette assembly that is adaptable to the grip of each artist.

Briefly, an improved artist sketch box that is constructed in accordance with the principles of the present invention has a planar bottom having attached thereto a front, two side, and rear upstanding walls along the planar bottom perimeter thereby forming a base compartment. A substantially planar lid member having a front edge, a rear edge and two side edges and having a peripheral configuration approximating that of the bottom is included. Laterally upstanding lid walls are attached to the planar lid along the rear and two side edges thereof. The planar lid includes a panel board member that is hinged to the front edge thereof and which includes a latch mechanism attached to the end of the panel board member that is furthest from where the panel board member is hinged to the planar lid. The rear lid wall opposite the panel board member is hinged to the rear upstanding wall of the planar bottom and when pivoted into planar alignment with the rear upstanding wall, will orient the upstanding lid walls and panel board member to cooperate with the upstanding walls of the bottom to form a box. The latch mechanism cooperates with a corresponding receiving latch that is attached to the front upstanding wall thereby securing the box in a closed position. An easel and palette assembly is stored inside the base compartment during transport and is removed during use and includes a palette base assembly that is hinged to an easel lid assembly. The easel lid assembly contains grooves that are adapted for receiving an artist's panel board. The easel lid assembly pivots with respect to the palette base assembly into a desired position and is secured in position by tightening a thumb screw passing through a slot of a pivotable side brace.

DETAILED DESCRIPTION OF THE INVENTION

Figure 1:
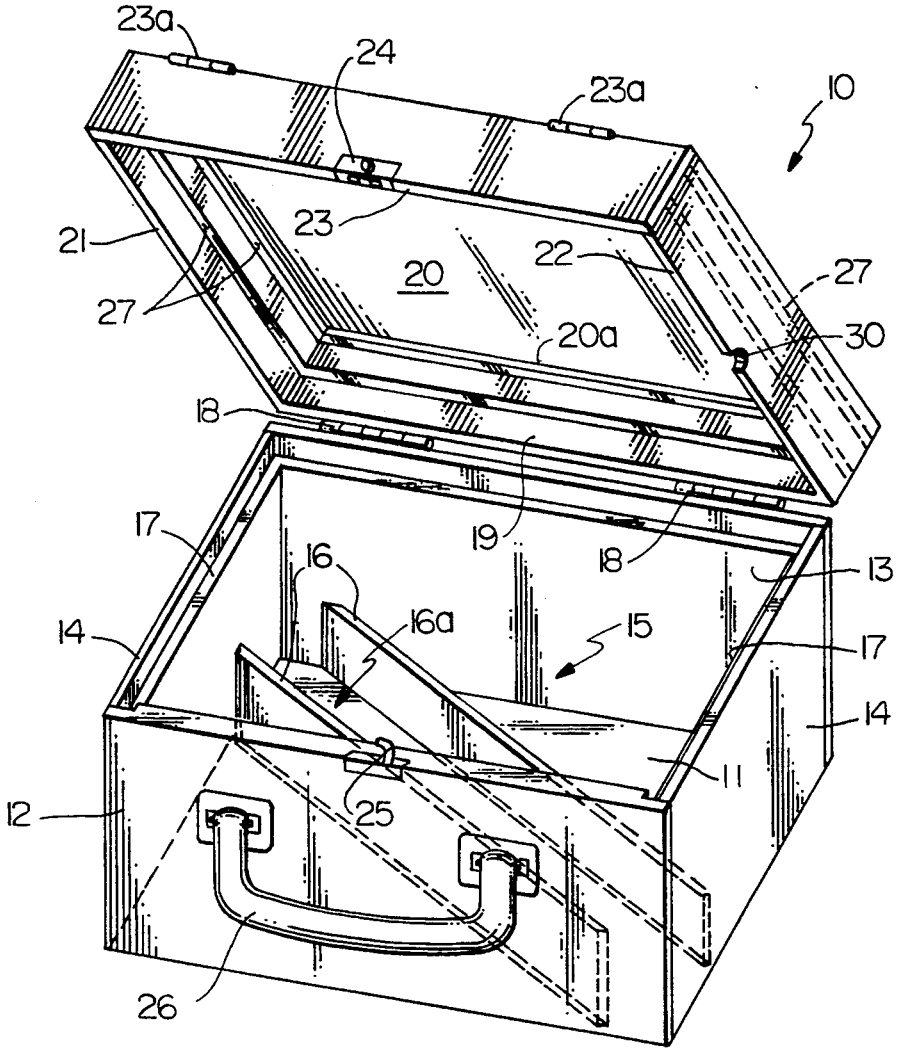
FIG. 1 is a view in perspective of an improved artist sketch box with the palette and easel assembly removed for purpose of clarity.

Referring to FIG. 1 is shown, an improved artist sketch box, identified in general by the numeral 10. An integrated palette and easel assembly (identified by reference numeral 32 of FIG. 3) has been removed from the sketch box 10 of the FIG. 1 drawing to provide additional clarity of detail and is described in greater detail hereinbelow. Any suitable material, such as wood, plastic, and the like are anticipated for the construction of the sketch box 10.

The sketch box 10 includes a planar bottom 11 surface. Attached to the bottom 11 along the perimeter are a front upstanding wall 12, rear upstanding wall 13, and two side upstanding walls 14 which together form a base compartment, identified in general by the numeral 15.

Inside the base compartment 15 are preferably attached two or more diagonal members 16. The area disposed between the diagonal members 16 form a diagonal compartment **16*a* that is well adapted for receiving long paint brushes (not shown) and other lengthy types of artist supplies that would not otherwise fit within the base compartment 15 if they were placed therein parallel to any of the upstanding walls 12, 13, 14. The diagonal members 16 also serve to segregate the remainder of the base compartment 15** into other areas that are useful for the storage of paints (not shown), paint thinner (not shown), medium cups (not shown), and the like.

The two side upstanding walls 14 each contain a ledge 17 that is adapted for receiving a rail (reference numerals 41, 42 FIG. 3) of the easel and palette assembly (reference numeral 32 FIG. 3) and is described in greater detail hereinbelow. Attached to the rear upstanding wall 13 are one or more hinges 18 which pivotally interconnect the rear upstanding wall 13 to a bottom end of a rear lid wall 19.

The top end of the rear lid wall 19 is attached to a planar lid 20 member at the rear edge **20*a* thereof. The planar lid 20 has a peripheral configuration approximating that of the planar bottom 11. Attached to the two side edges of the planar lid 20 are first lid side wall 21 and a second lid side wall 22. Hinged to the front edge of the planar lid 20 is a panel board member 23 by the use of one or more panel board hinges 23*a***.

The panel board member 23 includes a first part of a latch 24 mechanism. Attached to the end of the front upstanding wall 12 furthest from the planar bottom 11 is a second part of a latch 25 mechanism.

When the rear lid wall 19 is pivoted about the hinges 18 so as to cause the rear lid wall 19 to come substantially into planar alignment with the rear upstanding wall 13, the rear lid wall 19, first lid side wall 21, and second lid side wall 22 cooperate with the rear upstanding wall 13 and two side upstanding walls 14 respectively and the panel board member 23 cooperates with the front upstanding wall 12 to form a box. The first part of a latch 24 aligns with and cooperates with the second part of a latch 25 to secure the box in the closed position for transport.

A handle 26 is attached to the front upstanding wall 13 and is used for carrying the sketch box 10 during transport. According to a modification a modified front upstanding wall (not shown) is included which is slightly higher than the rear upstanding wall 13 and the two side upstanding walls 14. A higher modified front upstanding wall permits locating the handle 26 closer to the mechanical center of the sketch box 10 thereby improving both transportation and appearance when the sketch box 10 is closed. Of course, when a higher type of modified front upstanding wall is used a shorter modified panel board member (not shown) must be used as well.

Longitudinal spaced apart grooves 27 are provided on the inside surfaces of the rear lid wall 19, first lid side wall 21, and second lid side wall 22 that are each adapted for receiving one or more artist's panel boards (not shown). Access for inserting or for removing the artist boards from each of the grooves 27 is obtained by pivoting the panel board member 23 about the panel board hinges **23*a* in a direction that is generally away from the first lid side wall 21 and the second lid side wall 22**.

Figure 2:
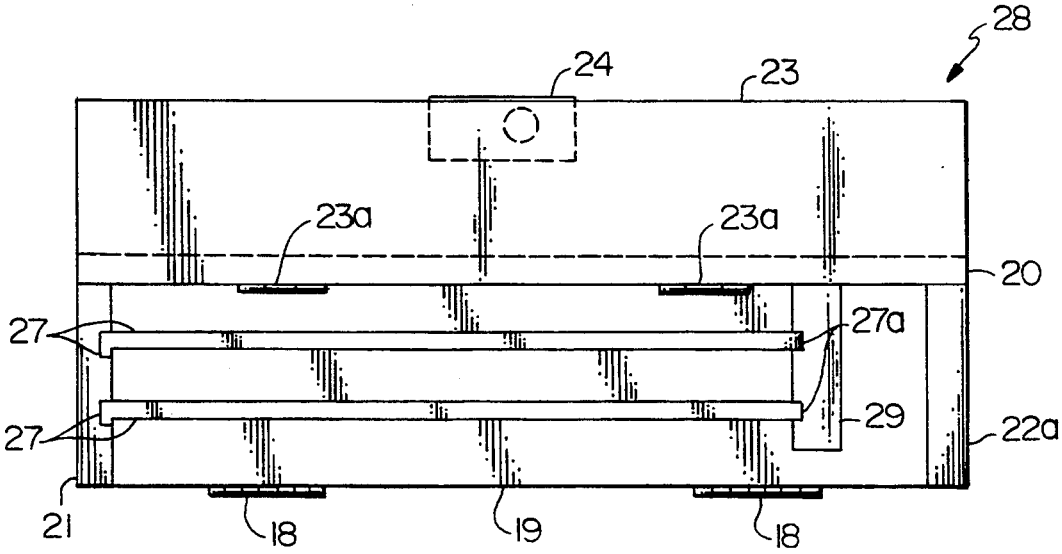
FIG. 2 is a front elevational view of the lid assembly of the improved artist box.

Referring on occasion to FIG. 2, is shown a modified type of planar lid assembly, identified in general by the reference numeral 28. The panel board member 23 as shown in FIG. 2 is pivoted into the open position to allow access for inserting or for removing artist boards from the grooves 27.

A modified second lid side wall **22*a* is included which does not include any grooves. A longitudinal groove block 29 approximating the length of the first lid side wall 21 is attached to the planar lid 20 parallel to the first lid side wall 21 at a predetermined distance apart from the first lid side wall 21. The groove block 29 contains matching grooves 27*a* which align with the grooves 27 of the first lid side wall 21 and rear lid wall 19**.

The groove block 29 is included to permit receiving artist boards (not shown) that are smaller in width than is the distance between the first lid side wall 21 and the second lid side wall 22.

A notch 30 is provided in the side of the second lid side wall 22 and is used to provide clearance, if necessary, for a thumbscrew (identified by reference numeral 31, FIG. 3) and is described in greater detail hereinbelow.

Figure 3:
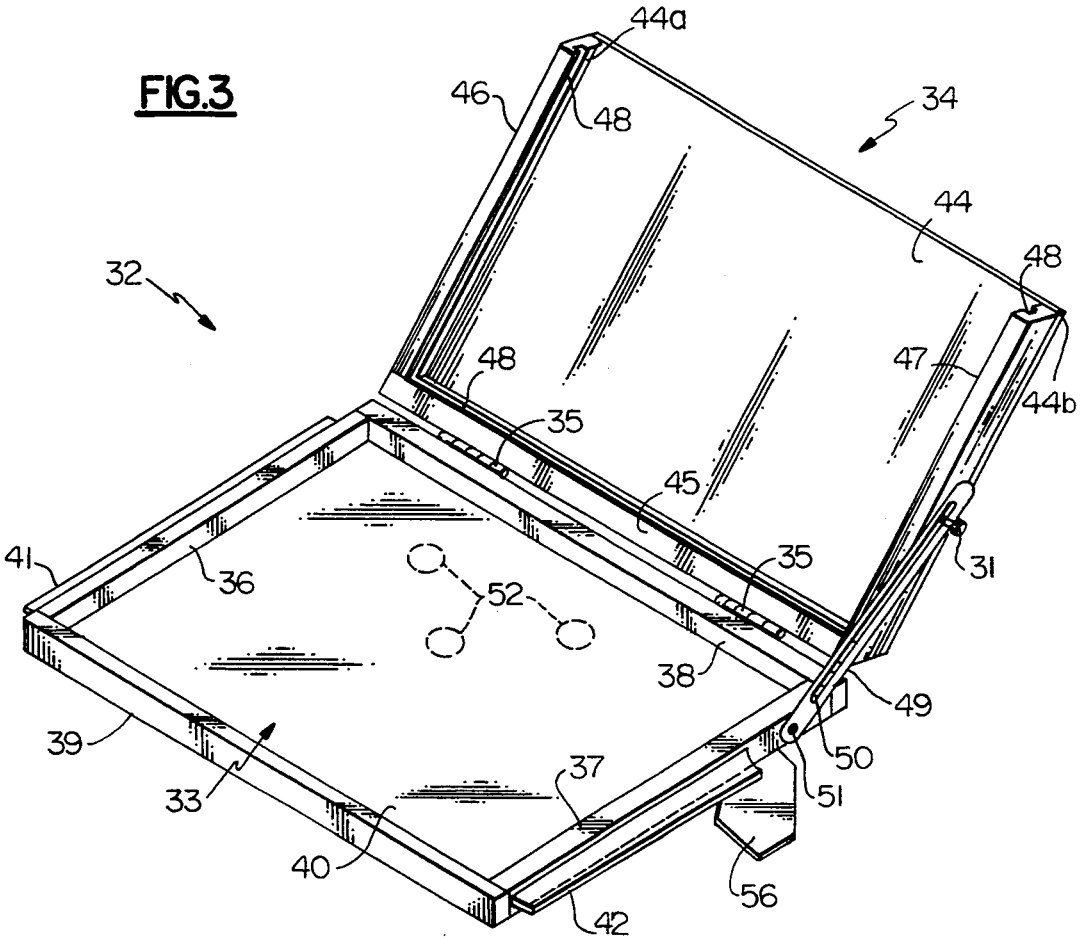
FIG. 3 is a view in perspective of the palette and easel assembly.
Figure 4:
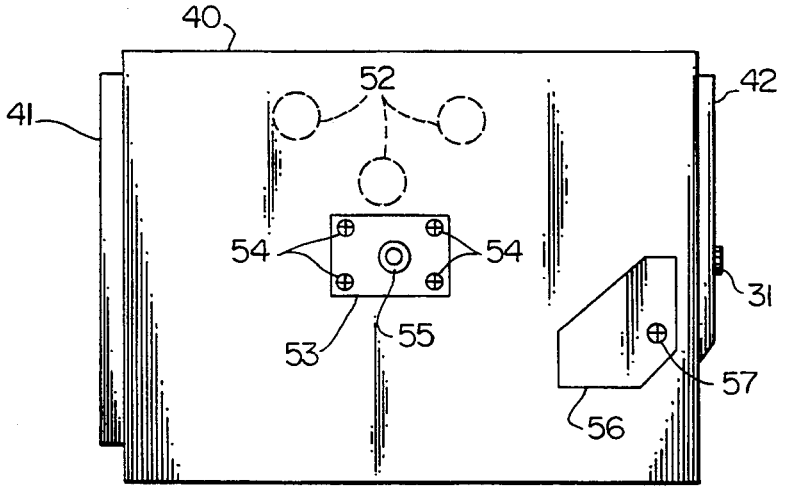
FIG. 4 is a bottom elevational view of the palette and easel assembly.

Referring now to FIG. 3 and on occasion to FIG. 4, is shown an easel and palette assembly identified in general by the reference numeral 32. The easel and palette assembly 32 includes a substantially planar palette base assembly 33 that is pivotally interconnected to a substantially planar easel assembly 34 by one or more palette hinges 35.

The palette base assembly 33 preferably includes a first palette side member 36, second palette side member 37, rear palette member 38, and front palette member 39 attached generally about the perimeter of a palette base plate 40 to provide increased structural strength to the palette base assembly 33 and to also define an enclosure around the perimeter of the palette base plate 40. The enclosure is useful to prevent artist brushes or paint (not shown) and the like which may be placed upon the palette base plate 40 from falling off the edge.

The enclosure also serves to maintain the palette base plate 40 disposed a predetermined minimum distance away from the planar easel assembly 34 when the palette base assembly 33 is pivoted about the palette hinges 35 generally towards the easel assembly 34. The predetermined minimum distance ensures that any paint which may be left directly upon the palette base plate 40 after completion of sketching by the artist will remain undisturbed.

Attached to the first palette side 36 is a full length rail 41. Attached to the second palette side 37 is a partial length rail 42. When the palette base assembly 33 and easel assembly 34 are pivoted so that the easel assembly 34 and palette base assembly 33 are parallel to each other, the easel and palette assembly 32 is in the closed, or transport position, and can then be stored inside of the base compartment 15 of the sketch box 10.

When the easel and palette assembly 32 is placed inside the base compartment 15, the full length rail 41 and the partial length rail 42 each rest upon the ledge 17 surfaces of the two upstanding walls 14. The notch 30 provides clearance for the thumbscrew 31. The clearance is necessary to allow the second lid side wall 22 to close sufficiently far to be able to cooperate with the side upstanding wall 14 when compact types of sketch boxes 10 are fabricated.

The easel assembly 34 includes an easel plate 44. Attached to an edge of the easel plate 44 nearest to where the palette hinges 35 are attached is included a rear easel member 45. A first side easel member 46 is attached perpendicular to the rear easel member to a first edge 44*a* of the easel plate 44 and a second side easel member 47 is attached at the opposite edge of the easel plate 44 to a second edge 44*b*.

The rear easel member 45, first side easel member 46, and second side easel member 47 each contain a longitudinal easel groove 48 adapted for receiving an artist board (not shown) that is to be sketched upon.

A side brace 49 having a slot 50 is pivotally attached to the second palette side 37 by a brace screw 51 or similar type of fastener.

In use the easel and palette assembly 32 is removed from the sketch box 10 base compartment 15 and the thumbscrew 31 is loosened to allow the slot 50 and the side brace 49 to slide relative to the thumbscrew 31 when the easel assembly 34 is pivoted about the palette hinges 35 with respect to the palette base assembly 33 into a generally open position as shown. The thumbscrew 31 is then tightened which secures the side brace 49 in position relative to the thumbscrew 31 and therefore also secures the easel assembly 34 in position relative to the palette base assembly 33. An artist board (not shown) is then slid into the longitudinal easel grooves 48.

The easel and palette assembly 32 is normally held by the artist by hand. A thumbhole (not shown) is often preferred by artists to grasp a palette. The palette base plate 40, if preferred for the material used for its construction, includes a plurality of knock-out holes 52. The artist is able to remove the knock-out hole 52 of his preference and to insert his thumb therein while holding the easel and palette assembly 32 during sketching.

Knock-out holes 52 are preferred when the palette base plate 40 is constructed of plastic and other similar types of materials. The use of knock-out holes 52 is determined by the artist preference when wood is used for the construction of the palette base plate 40. This is because certain artists will feel entirely comfortable in cutting a thumbhole in the location of their choosing in the palette base plate 40 if it is constructed of wood, whereas certain other artists will not prefer to cut a thumbhole and will prefer having a knock-out hole 52 available regardless of the material used to construct the palette base plate 40.

The knock-out holes 52 are formed by methods that are well known and include the use of a press to weaken and to score the palette base plate 40 at the circumference of the knock-out holes 52 or by manufacture of the palette base plate 40 with less material present at the circumference of each of the knock-out holes 52.

A screw adapter plate 53 is shown in FIG. 4 attached to the bottom surface of the palette base plate 40 by plate screws 54. The screw adapter plate 53 includes a female threaded portion 55 having a thread pitch and bolt diameter that is compatible for receiving the male bolt portion of most camera types of tripods (not shown). For most common types of tripods, a female threaded portion 55 adapted to receive a $\frac{1}{4}$ machine screw size by 20 threads per inch bolt is preferred.

For larger types of sketch boxes 10 or for use when the easel and palette assembly 32 is to be used for protracted periods of time in one location, some artists will prefer to bring a camera type of tripod along as well and to mount the easel and palette assembly 32 upon the tripod by screwing the tripod screw (not shown) into the female threaded portion 55 of the screw adapter plate 53.

When sketching is complete the artist can either choose to leave the panel board containing the completed sketch in the easel grooves 48 or he may prefer to remove the panel board from the easel and palette assembly 32 and insert the completed panel board into one of the grooves 27 that are provided on the inside surfaces of the rear lid wall 19, first lid side wall 21, and second lid side wall 22 while another fresh panel board is inserted into the easel grooves 48 for sketching upon.

Some artists rely upon a medium (not shown) to clean their artist brushes or to thin their paints during sketching. A medium cup (not shown) is a known type of device that is used by artists to contain the preferred type of medium during painting. Certain types of known medium cups contain a clip type of fastening device that is affixed to the bottom of the medium cup and is used to secure the medium cup to any thin type of plate.

A medium cup support 56 that is adapted for receiving a medium cup is pivotally attached to one side of the palette base plate 40 by a medium screw 57 passing through a hole provided in the medium cup support 56. In use the medium cup support 56 is pivoted about the medium screw 57 until it protrudes out from the palette base plate 40 as shown in FIG. 3. A medium cup is clipped onto the medium cup support 56 and a small quantity of medium is placed therein.

At the conclusion of work, the medium cup is removed from the medium cup support 56 and the support 56 is pivoted about the medium screw 57 until it is fully contained under the palette base plate 40. The medium screw 57 supplies sufficient tension to the medium cup support 56 to retain the medium cup support 56 in any position relative to the palette base plate 40 that it has been manually pivoted to by the artist.

At the conclusion of sketching the thumbscrew 31 is also loosened and the easel assembly 34 is pivoted about the palette hinges 35 with respect to the palette base assembly 33 into a generally closed position. When the easel and palette assembly 32 is closed, the side brace 49 pivots about the brace screw 51 until the easel assembly 34 and palette base assembly 33 are in contact with each other. At this time, the side brace 49 is positioned slightly above the partial length rail 42. The length of the partial rail 42 is reduced in the general area of the brace screw 51 to allow room for the side brace 49 to pivot as is required.

The closed easel and palette assembly 32 is then placed inside the base compartment 15 along with any artist brushes or other supplies that were removed therefrom and the sketch box 10 is then closed and latched ready for transport.

The invention has been shown, described and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. An artist sketch box, comprising:

a substantially planar bottom having a length and a width and a thickness;

a front upstanding wall, a rear upstanding wall, and two side upstanding walls attached generally about the perimeter of said planar bottom to form a compartment having an open top; a substantially planar lid having a front edge, a rear edge, and two side edges and having a length and a width approximating said length and said width of said planar bottom;

a first upstanding lid wall attached to said rear edge, a second upstanding lid wall attached to one of said two side edges, a third upstanding lid wall attached to the remainder of said two side edges;

a panel board member hinged at a first end to said front edge by a first means for providing a hinge and having attached a first part of a means for providing a latch at an end of said panel board member opposite to said first end;

said first upstanding lid wall hinged to said rear upstanding wall at a side opposite to where said first upstanding lid wall is attached to said rear edge by a second means for providing a hinge;

a second part of a means for providing a latch attached to said front upstanding wall at an end opposite where said front upstanding wall is attached to said planar bottom;

an easel and palette assembly including a palette base assembly and an easel assembly;

said palette base assembly hinged to said easel assembly by a palette hinge;

said easel assembly including an easel member attached to an edge of said easel plate nearest to said palette hinge, a first side easel member attached to a second edge of said easel plate that is perpendicular to said rear easel member, and a second side easel member attached to third edge of said easel plate opposite to said second edge;

wherein said rear easel member, said first side easel member, and said second side easel member each contain a longitudinal panel board groove in general alignment with each other that is adapted for receiving an artist panel board;

said palette base assembly includes a palette base plate having a first palette side member, a second palette side member, a rear palette member, and a front palette member attached generally about the perimeter of said palette base plate and includes a knock-out hole in said palette base plate for providing a hole where desired to insert a thumb therein;

said easel and palette assembly removable separate and apart from said compartment during use and capable of being stored generally in said compartment during transportation; said palette base assembly including a side brace pivotally attached thereto and a thumbscrew for securing said side brace in position with respect to said easel assembly thereby securing said palette base assembly in position relative to said easel assembly; and said compartment being adapted for receiving said easel and palette assembly;

whereby upon said panel board member being pivoted about said first means for providing a hinge to a position that is generally closest to one end each of said second upstanding lid wall and of said third upstanding lid wall and upon said first upstanding lid wall being pivoted about said second means for providing a hinge to a position where said first upstanding lid wall is generally in planar alignment with said rear upstanding wall, said first upstanding lid wall, said second upstanding lid wall, and said third upstanding lid wall cooperate with said rear upstanding wall, said two side upstanding walls, and said panel board member also cooperates with said front upstanding wall to form, generally, a box.

2. The artist sketch box of claim 1 wherein said first part of said means for providing a latch cooperates with said second part of said means for providing a latch to secure said box in a generally closed position.

3. The artist sketch box of claim 1 wherein said first upstanding lid wall, said second upstanding lid wall, and said third upstanding lid wall each contain a longitudinal groove generally in alignment with each other that is adapted for receiving an artist panel board.

4. The artist sketch box of claim 3 wherein said longitudinal groove is adapted for receiving a plurality of said artist panel boards.

5. The artist sketch box of claim 3 wherein said longitudinal groove includes a plurality of longitudinal grooves.

6. The artist sketch box of claim 5 wherein each of said plurality of longitudinal grooves is adapted for receiving a plurality of said artist panel boards.

7. The artist sketch box of claim 3 wherein said panel board member pivots about said first means for providing a hinge to provide access for inserting or removing said artist panel board from said longitudinal groove.

8. The artist sketch box of claim 3 including a groove block attached to said planar lid a predetermined distance apart from said first upstanding lid wall and containing a longitudinal block groove formed in said groove block that is generally in alignment with said longitudinal groove of said first upstanding lid wall and said second upstanding lid wall that is adapted for receiving said artist panel board.

9. The artist sketch box of claim 1 wherein said compartment includes a diagonal member affixed to said bottom and further defining said area within said compartment.

10. The artist sketch box of claim 9 wherein said diagonal member includes a plurality of diagonal members.

11. The artist sketch box of claim 1 including a handle attached to said improved artist sketch box for carrying said artist sketch box.

12. The artist sketch box of claim 1 wherein said two upstanding side walls each contain a ledge adapted for receiving and for retaining thereon said easel and palette assembly.

13. The artist sketch box of claim 1 wherein said side brace includes a slot adapted for receiving said thumbscrew.

14. An artist sketch box, comprising:

a substantially planar bottom having a length and a width and a thickness;

a front upstanding wall, a rear upstanding wall, and two side upstanding walls attached generally about the perimeter of said planar bottom to form a compartment having an open top;

a substantially planar lid having a front edge, a rear edge, and two side edges and having a length and a width approximating said length and said width of said planar bottom;

a first upstanding lid wall attached to said rear edge, a second upstanding lid wall attached to one of said two side edges, a third upstanding lid wall attached to the remainder of said two side edges;

a panel board member hinged at a first end to said front edge by a first means for providing a hinge and having attached a first part of a means for providing a latch at an end of said panel board member opposite to said first end;

said first upstanding lid wall hinged to said rear upstanding wall at a side opposite to where said first upstanding lid wall is attached to said rear edge by a second means for providing a hinge;

a second part of a means for providing a latch attached to said front upstanding wall at an end opposite where said front upstanding wall is attached to said planar bottom;

an easel and palette assembly including a palette base assembly and an easel assembly;

said palette base assembly hinged to said easel assembly by a palette hinge;

said palette base assembly including a side brace pivotally attached thereto and a thumbscrew for securing said side brace in position with respect to said easel assembly thereby securing said palette base assembly in position relative to said easel assembly;

said easel and palette assembly removable separate and apart from said compartment during use and capable of being stored generally in said compartment during transportation; and said compartment being adapted for receiving said easel and palette assembly;

whereby upon said panel board member being pivoted about said first means for providing a hinge to a position that is generally closest to one end each of said second upstanding lid wall and of said third upstanding lid wall and upon said first upstanding lid wall being pivoted about said second means for providing a hinge to a position where said first upstanding lid wall is generally in planar alignment with said rear upstanding wall, said first upstanding lid wall, said second upstanding lid wall, and said third upstanding lid wall cooperate with said rear upstanding wall, said two side upstanding walls, and said panel board member also cooperates with said front upstanding wall to form, generally, a box.

15. An artist sketch box, comprising:

a substantially planar bottom having a length and a width and a thickness;

a front upstanding wall, a rear upstanding wall, and two side upstanding walls attached generally about the perimeter of said planar bottom to form a compartment having an open top;

a substantially planar lid having a front edge, a rear edge, and two side edges and having a length and a width approximating said length and said width of said planar bottom;

a first upstanding lid wall attached to said rear edge, a second upstanding lid wall attached to one of said two side edges, a third upstanding lid wall attached to the remainder of said two side edges;

a panel board member hinged at a first end to said front edge by a first means for providing a hinge and having attached a first part of a means for providing a latch at an end of said panel board member opposite to said first end;

said first upstanding lid wall hinged to said rear upstanding wall at a side opposite to where said first upstanding lid wall is attached to said rear edge by a second means for providing a hinge;

a second part of a means for providing a latch attached to said front upstanding wall at an end opposite where said front upstanding wall is attached to said planar bottom;

an easel and palette assembly including a palette base assembly and an easel assembly;

said palette base assembly hinged to said easel assembly by a palette hinge;

said easel assembly including an easel plate, a rear easel member attached to an edge of said easel plate nearest to said palette means for providing a hinge, a first side easel member attached to a second edge of said easel plate that is perpendicular to said rear easel member, and a second side easel member attached to third edge of said easel plate opposite to said second edge;

wherein said rear easel member, said first side easel member, and said second side easel member each contain a longitudinal panel board groove in general alignment with each other that is adapted for receiving an artist panel board;

said easel and palette assembly removable separate and apart from said compartment during use and capable of being stored generally in said compartment during transportation; and said compartment being adapted for receiving said easel and palette assembly;

whereby upon said panel board member being pivoted about said first means for providing a hinge to a position that is generally closest to one end each of said second upstanding lid wall and of said third upstanding lid wall and upon said first upstanding lid wall being pivoted about said second means for providing a hinge to a position where said first upstanding lid wall is generally in planar alignment with said rear upstanding wall, said first upstanding lid wall, said second upstanding lid wall, and said third upstanding lid wall cooperate with said rear upstanding wall, said two side upstanding walls, and said panel board member also cooperates with said front upstanding wall to form, generally, a box.

16. An artist sketch box, comprising:

a substantially planar bottom having a length and a width and a thickness;

a front upstanding wall, a rear upstanding wall, and two side upstanding walls attached generally about the perimeter of said planar bottom to form a compartment having an open top;

a substantially planar lid having a front edge, a rear edge, and two side edges and having a length and a width approximating said length and said width of said planar bottom;

a first upstanding lid wall attached to said rear edge, a second upstanding lid wall attached to one of said two side edges, a third upstanding lid wall attached to the remainder of said two side edges;

a panel board member hinged at a first end to said front edge by a first means for providing a hinge and having attached a first part of a means for providing a latch at an end of said panel board member opposite to said first end;

said first upstanding lid wall hinged to said rear upstanding wall at a side opposite to where said first upstanding lid wall is attached to said rear edge by a second means for providing a hinge;

a second part of a means for providing a latch attached to said front upstanding wall at an end opposite where said front upstanding wall is attached to said planar bottom;

an easel and palette assembly including a palette base assembly and an easel assembly;

said palette base assembly hinged to said easel assembly by a palette hinge;

said palette base assembly includes a palette base plate having a first palette side member, a second palette side member, a rear palette member, and a front palette member attached generally about the perimeter of said palette base plate and includes a knock-out hole in said palette base plate for providing a hole where desired to insert a thumb therein;

said easel and palette assembly removable separate and apart from said compartment during use and capable of being stored generally in said compartment during transportation; and said compartment being adapted for receiving said easel and palette assembly;

whereby upon said panel board member being pivoted about said first means for providing a hinge to a position that is generally closest to one end each of said second upstanding lid wall and of said third upstanding lid wall and upon said first upstanding lid wall being pivoted about said second means for providing a hinge to a position where said first upstanding lid wall is generally in planar alignment with said rear upstanding wall, said first upstanding lid wall, said second upstanding lid wall, and said third upstanding lid wall cooperate with said rear upstanding wall, said two side upstanding walls, and said panel board member also cooperates with said front upstanding wall to form, generally, a box.

17. An artist sketch box, comprising:

a substantially planar bottom having a length and a width and a thickness;

a front upstanding wall, a rear upstanding wall, and two side upstanding walls attached generally about the perimeter of said planar bottom to form a compartment having an open top;

said compartment including a plurality of diagonal members affixed to said planar bottom, further defining said area within said compartment to include at least one diagonal compartment attached to said planar bottom;

a substantially planar lid having a front edge, a rear edge, and two side edges and having a length and a width approximating said length and said width of said planar bottom;

a first upstanding lid wall attached to said rear edge, a second upstanding lid wall attached to one of said two side edges, a third upstanding lid wall attached to the remainder of said two side edges;

a panel board member hinged at a first end to said front edge by a first means for providing a hinge and having attached a first part of a means for providing a latch at an end of said panel board member opposite to said first end;

said first upstanding lid wall hinged to said rear upstanding wall at a side opposite to where said first upstanding lid wall is attached to said rear edge by a second means for providing a hinge;

a second part of a means for providing a latch attached to said front upstanding wall at an end opposite where said front upstanding wall is attached to said planar bottom;

an easel and palette assembly including a palette base assembly and an easel assembly;

said palette base assembly hinged to said easel assembly by a palette hinge;

said easel and palette assembly removable separate and apart from said compartment during use and capable of being stored generally in said compartment during transportation; and said compartment being adapted for receiving said easel and palette assembly;

whereby upon said panel board member being pivoted about said first means for providing a hinge to a position that is generally closest to one end each of said second upstanding lid wall and of said third upstanding lid wall and upon said first upstanding lid wall being pivoted about said second means for providing a hinge to a position where said first upstanding lid wall is generally in planar alignment with said rear upstanding wall, said first upstanding lid wall, said second upstanding lid wall, and said third upstanding lid wall cooperate with said rear upstanding wall, said two side upstanding walls, and said panel board member also cooperates with said front upstanding wall to form, generally, a box.

* * * * *